US006598843B1

(12) United States Patent
Bell et al.

(10) Patent No.: US 6,598,843 B1
(45) Date of Patent: Jul. 29, 2003

(54) EXTENDABLE BRACKET FOR WINDOW COVERING COMPONENTS

(75) Inventors: Ronald T. Bell, Jamestown, NC (US); Stan Chudzik, High Point, NC (US); James L. Daniels, Stokesdale, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 10/102,261

(22) Filed: Mar. 20, 2002

(51) Int. Cl.[7] ..... A47H 1/10; A47H 1/14

(52) U.S. Cl. ..... 248/261; 248/251; 248/254; 248/256; 248/257; 248/260

(58) Field of Search ..... 248/251, 254, 248/256, 257, 260, 262, 269, 261, 252; 403/326, 329; 160/330, 350

(56) References Cited

U.S. PATENT DOCUMENTS

| | | | | | |
|---|---|---|---|---|---|
| 375,412 | A | | 12/1887 | Creque | 248/909 |
| 908,849 | A | | 1/1909 | Ferris | |
| 994,448 | A | | 6/1911 | Ferris | |
| 1,050,437 | A | | 1/1913 | Edsall | |
| 1,077,083 | A | | 10/1913 | Kroder | |
| 1,150,274 | A | | 8/1915 | Lathrop | |
| 1,279,543 | A | | 9/1918 | Hills | |
| 1,801,477 | A | | 4/1931 | Ainsworth | |
| 2,111,357 | A | | 3/1938 | Cornell, Jr. | 248/58 |
| 2,201,043 | A | * | 5/1940 | Kirsch | 156/22 |
| 2,498,590 | A | | 2/1950 | Straus | 248/264 |
| 2,790,558 | A | | 4/1957 | Rosenbaum | 211/105.2 |
| 2,916,159 | A | * | 12/1959 | O'Neil | 211/89 |
| 3,384,987 | A | | 5/1968 | Prechtl | 40/152.1 |
| 3,624,954 | A | | 12/1971 | van der Veken | 46/11 |
| 3,675,883 | A | * | 7/1972 | Holmes et al. | 248/251 |
| 3,795,380 | A | * | 3/1974 | Turner | 248/263 |
| 4,068,345 | A | | 1/1978 | Hehl et al. | 16/94 D |
| 4,079,838 | A | | 3/1978 | Granum | 211/26 |
| 4,283,035 | A | * | 8/1981 | Ojembarrena et al. | 248/263 |
| 4,345,762 | A | | 8/1982 | Lebelson | 273/157 |
| 4,747,182 | A | | 5/1988 | Darner | 16/87.4 R |
| 4,889,305 | A | * | 12/1989 | Mahan | 248/265 |
| 5,082,226 | A | * | 1/1992 | Mahan | 248/265 |
| 5,106,093 | A | | 4/1992 | Engel | 273/160 |
| 5,303,832 | A | * | 4/1994 | Tu | 211/105.4 |
| 5,421,551 | A | * | 6/1995 | LeClaire | 248/257 |
| 5,615,850 | A | | 4/1997 | Cloninger | 248/68.1 |
| 5,706,878 | A | | 1/1998 | Guettler | 160/369 |
| 6,053,726 | A | * | 4/2000 | Kanno | 431/144 |
| 6,471,177 | B1 | * | 10/2002 | Emrick | 248/544 |

FOREIGN PATENT DOCUMENTS

| | | | | |
|---|---|---|---|---|
| GB | 2222069 | * | 2/1990 | A47H/1/08 |

OTHER PUBLICATIONS

US Patent Publication US 2002/0066842A1, Curry, Jun. 2002, Class 248/261.*

* cited by examiner

*Primary Examiner*—Norie Chan
*Assistant Examiner*—Amy J. Sterling
(74) *Attorney, Agent, or Firm*—Marshall, Gerstein & Borun

(57) ABSTRACT

An extendable bracket assembly for supporting hardware components has a mounting base with a base plate. The base plate has an attachment side for mounting the base plate to a surface and has a support side opposite the attachment side. A base support element extends from the support side of the base plate. A first extension part has a first body with a proximal end adjacent the mounting base and a first extension support element that extends from an opposite distal end of the first body. The first extension part can be removed from and reattached to the base support element to adjust the bracket length as needed. The base support element is exposed when the first extension part is removed. The extendable bracket assembly can include a plurality of like extension parts to further increase the bracket length.

20 Claims, 2 Drawing Sheets

EXTENDABLE BRACKET FOR WINDOW COVERING COMPONENTS

FIELD OF THE INVENTION

The invention is generally related to mounting hardware, and more particularly to an extendable bracket for mounting window shades, curtain rods, and the like.

BACKGROUND OF THE INVENTION

There are countless different kinds of bracket hardware for mounting or hanging window coverings such as shades, blinds, curtain rods, and the like. Many of the hardware designs are fabricated having a number of components including a mounting base for securing the hardware to a surface, and a support bracket for supporting the window covering components. Many of these hardware components are typically fabricated from metal and utilize several fastener components to complete a hardware assembly. Often, hardware brackets for hanging window coverings are not adjustable in any way.

The mounting base and support bracket are also typically fabricated separately and provided as a loose assembly to the consumer. The consumer then must install the mounting base, mount or attach the support bracket, and secure the mounting base and support bracket together using one or more additional fasteners. The installation process can therefore be quite cumbersome. In addition, the metal parts can be relatively costly to manufacture, both relative to labor, material expense, and tooling costs. In some cases, numerous parts are provided separately to the consumer, who must then assemble the parts prior to installation.

Many bracket hardware designs are also adjustable in length to permit the installer to hang the window coverings at a desired distance from the mounting surface. Most of these bracket designs also utilize at least two separate components that telescope relative to one another and are thus slidable relative to one another to provide the length adjustability. Most of these designs have two or more metal parts that require multiple stamping operations to fabricate each part.

Several known hardware brackets are length adjustable and utilize only a single bracket component per side of a window covering support rod. For example, U.S. Pat. No. 4,762,162 discloses a unitary hardware bracket for mounting window shades. The bracket is length adjustable by snapping or breaking off portions of the mounting end of the bracket. The wall mounting end can be shortened by breaking off one section of mounting holes and tangs. Another set of holes and tangs is left behind for mounting the bracket. However, if a consumer breaks off too much of the bracket during installation, rendering the bracket too short for the particular application, the only remedy is to purchase another bracket set.

U.S. Pat. No. 2,752,991 discloses a window cornice mounting bracket assembly that also can be length adjusted at the wall mounting end by snapping off pieces of the bracket. Again, however, too much of the bracket can be accidentally or unintentionally broken off during installation.

Another problem with many current mounting hardware designs is that the brackets come only with a fixed length. A retailer and/or a manufacturer typically may offer a number of different bracket options. A series of similar brackets may be offered where each bracket in the series has a different, fixed length. In many cases, a retailer will offer, for example, four similar brackets having different lengths. The consumer must select the proper one, take it home, and install it. Many times, the selected bracket is either too short or too long for a particular job.

To illustrate, a consumer may be installing a curtain rod over a window that already has a blind installed. The curtain rod may need to extend further from the wall surface than the blind mounting brackets. The consumer therefore must either select the correct brackets the first time. If not, the consumer must return to the store, return the incorrect brackets, and re-purchase the correct brackets. This results in unnecessary extra effort for both the consumer and retailer. Alternatively, a consumer may choose to purchase a number of the different length brackets and use only the correct ones. The unused brackets likely will not be used, resulting in unnecessary expense and waste of resources.

Either or both the manufacturer and retailer must also manufacture, stock, sip, unload, and keep track of each of the bracket options. Manufacturers and retailers often stock, store, display, and track product quantities and qualities according to computerized data, such as SKU numbers. Having four different brackets requires storage and shelf space for four different products and also requires tracking four different SKU numbers. This simply adds cost and complexity for both the manufacturer and the retailer.

BRIEF DESCRIPTION OF THE DRAWINGS

Exemplary brackets constructed in accordance with the teachings of the present invention are described and explained in greater detail below with the aid of the drawing figures in which.

DETAILED DESCRIPTION OF THE PREFERRED EMBODIMENTS

Though the disclosed mounting bracket assembly is described for use in hanging window coverings, the bracket assembly can be adapted for mounting or hanging other objects as well. The disclosed bracket assembly is adjustable in length and can be shortened or lengthened as desired and as many times as necessary. Once the mounting base of the bracket is attached to a surface, no additional fasteners or tools are needed to adjust the bracket length. Also, components of the bracket can be interchanged to alter the aesthetic characteristics of the assembly.

Various terminology is utilized herein to assist in describing features of the disclosed exemplary hardware mounting bracket constructed in accordance with the teachings of the present invention. Such terms are not intended to limit or restrict the permissible scope of the disclosed bracket to any particular orientation. The terms "proximal" and "distal" are utilized herein to describe the relationship between a mounting base and support section of the bracket. The terms are also used to relate various features of sub-elements of the bracket assembly. The term "proximal", as used herein, refers to elements being nearer or more closely spaced to the mounting base. The term "distal", as used herein, refers to elements being further or more distantly spaced relative to the mounting base.

Figure 2:
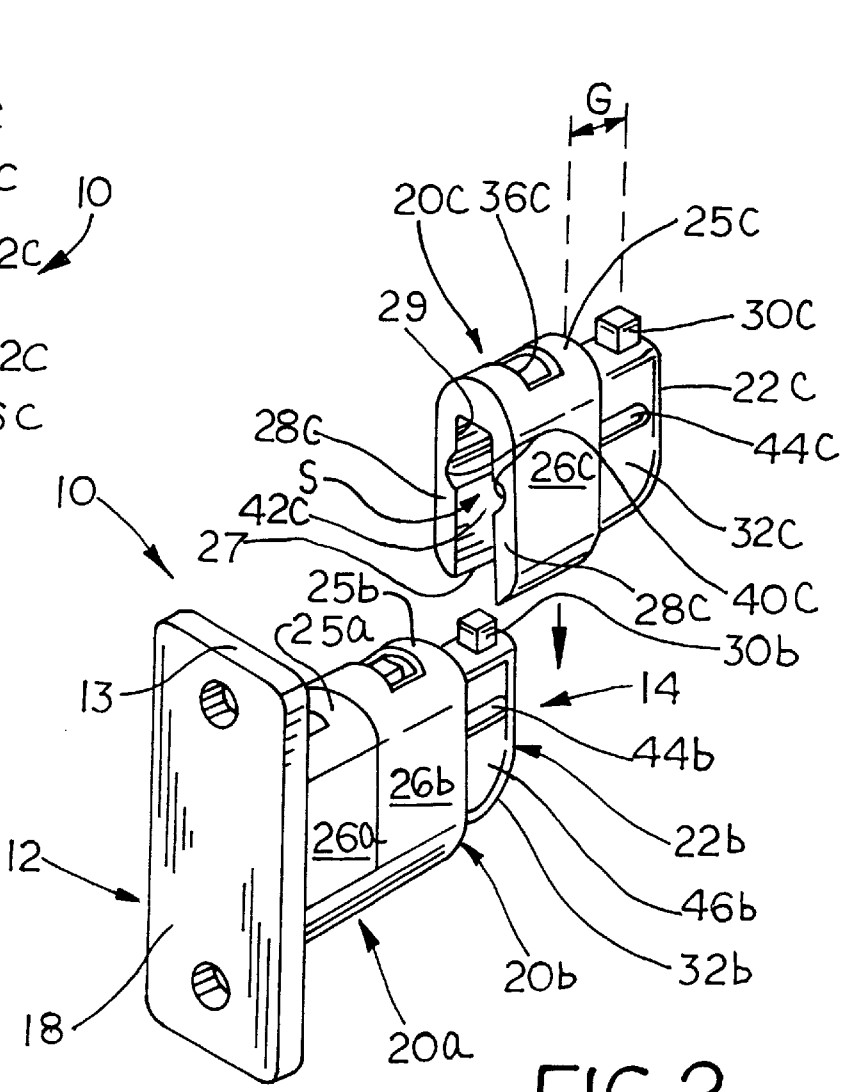
FIG. 2 is a rear elevation and perspective view of the extendable bracket assembly shown in FIG. 1.
Figure 1:
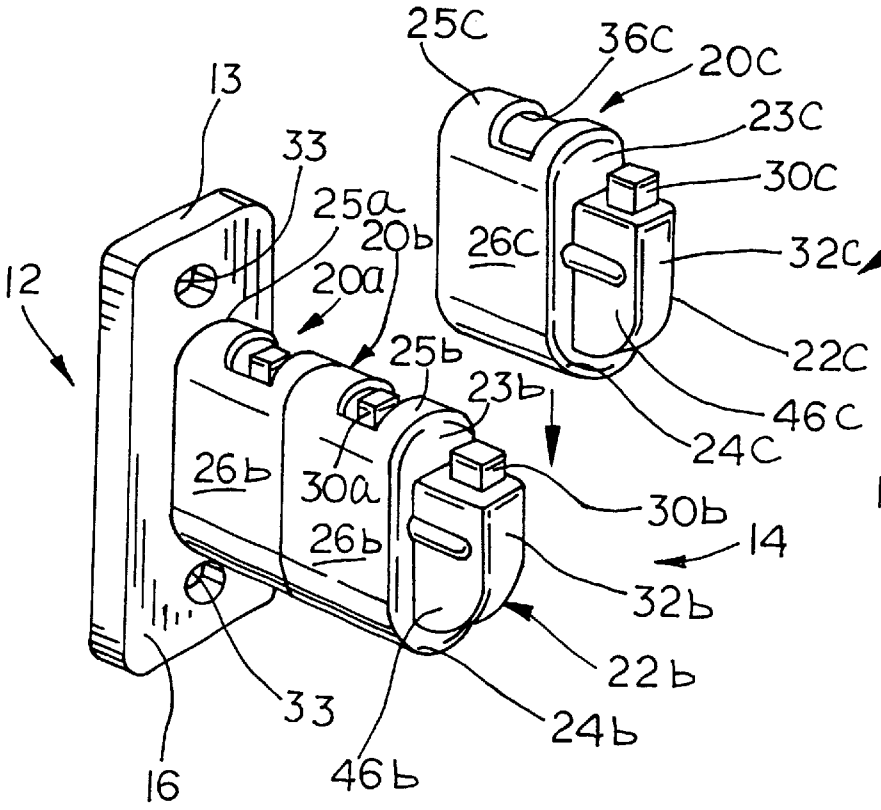
FIG. 1 is a front elevation and perspective view of one example of an extendable bracket assembly constructed according to the teachings of the present invention.

Referring now the drawings, FIGS. 1 and 2 generally illustrate one disclosed example of an extendable mounting bracket assembly 10 constructed according to the teachings of the present invention. The bracket assembly 10 generally has a mounting base 12 including a base plate 13. A length adjustable support section 14 extends from a support side 16 of the base plate 13. The support section 14 is oriented arranged so as to extend generally normal or perpendicular from the base plate 13 of the mounting base 12 in this disclosed example. However, other orientations and relationships are certainly permissible. The support section 14 is adapted to connect to and support an object such as a curtain rod or other window covering component. The base plate 13 of the mounting base 12 also has a mounting side 18 adapted to secure or mount the bracket assembly 10 to a surface, such as a wall or a wood trim part near a window.

As will be evident to those of ordinary skill in the art, the size, shape, and contour of both the mounting base 12 and the support section 14 components can vary considerably and yet fall within the scope of the present invention. Each particular mounting bracket constructed in accordance with the teachings of the present invention, such as one produced for supporting window covering components including a curtain rod, window shade, or the like, can be designed to accommodate various window sizes, hardware components, window covering sizes and shapes, interior design and decoration perimeters, and other overall space restrictions. Further, the extendable mounting bracket assembly 10, as described herein, is intended for selectively adjusting a distance between a mounting surface and a window covering component that is supported by the bracket. The size, shape, and configuration of the discrete extension parts described below can therefore also vary considerably and yet remain within the scope of the invention.

In general, the support section 14 includes one or more discrete, removable extension parts 20. The parts 20 can be selectively interconnected in series with one another to alter the length of the bracket assembly. The one or more extension parts 20 extend from the support side 16 of the mounting base 12. The number of parts 20 that can be utilized for a particular bracket installation can vary from zero to any number necessary to achieve a desired length, depending upon the characteristics for a particular hardware application.

In this disclosed example, three removable extension parts 20*a*, 20*b*, and 20*c* are illustrated. The part 20*a* is identified herein as the most proximal part since it is disposed nearest the support side 16 of the mounting base 12. The part 20*c* is identified herein as the most distal extension part, as it is the last exposed part of the support section 14. The part 20*b* is identified herein as intermediate extension part since it is disposed adjacent the proximal part 20*a* and is intermediate the most distal part 20*c*. More extension parts 20 can be added or removed as needed, thus resulting in more than one intermediate part 20*b*, to support a window covering component as described below. In one alternative example, the disclosed mounting bracket 10 can be provided with a plurality of additional intermediate extension parts 20*b* to increase the overall or maximum permissible length of the mounting bracket assembly 10 and support section 14 as well as to provide further length adjustment options for the bracket. In another alternative example, the mounting bracket assembly 10 can be provided with only the mounting base 12 and the most proximal extension part 20*a* to create a hardware bracket for only two selectable lengths.

In the disclosed example, each of the extension parts 20 has an extension support element 22 that is adapted to support or connect to a window covering component in a suitable manner, as is known to those of ordinary skill in the art. The support element 22 extends generally forward from a distal front end 23 of a body 24 of the part 20. Each disclosed body 24 generally has a closed top 25 that interconnects a pair of depending opposed and spaced apart sides 26. The distance between the sides at the respective bottom edges defines a bottom opening 27 of the body. Similarly, the distance between the sides 26 at the respective proximal or rear ends 28 defines a rear opening 29. The closed front end 23 and top 25 in conjunction with the distance between the sides 26 forms an interior space "S" within the body 24.

Each of the support elements 22 can be integrally provided as part of the body 24. In this example, each support element 22 is a hook having an upturned tab 30 extending from a protruding segment 32 that is connected to the front end 23 of the body 24. In one example, each of the parts 20 can be molded or otherwise formed from a suitable plastic or thermoplastic material as a unitary structure. For example, each part 20 can be injection molded from a poly carbonate material.

Figure 3:
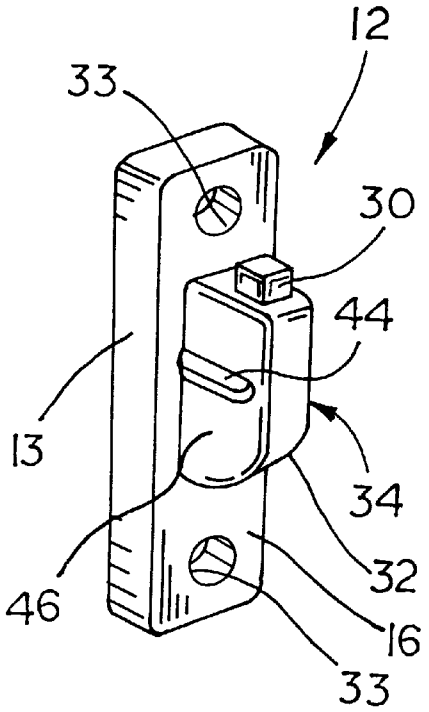
FIG. 3 is a front elevation and perspective view of the mounting base of the extendable bracket assembly shown in FIG. 1.

Referring to FIG. 3, the mounting plate 13 of the base 12 has a plurality of mounting openings 33 provided for securing the base to a surface in a conventional manner. The mounting base 12 also has a base support element 34 extending forward from the support side 16 of the base plate 13. In this example, the support element 34 is essentially identical to the support elements 22 of each of the extension parts 20 and has a projecting section 32 and an upturned tab 30. The support element 34 on the mounting base can be integrally formed as a part of the base plate, and in this example, is preferably so formed. As with the extension parts 20, the mounting base 12 can be molded or otherwise suitably formed from any desired material. In one example, the material is identical to that of the parts 20, such as poly carbonate. As will be evident to those having ordinary skill in the art, the structure and configuration of the support elements 22 and 34 can vary according to the needs and structure of a particular hardware component for which the bracket assembly 10 is intended to support.

The upwardly extending tab 30 on each of the support elements 22 and 34 serves a dual purpose in this example. One purpose is to assist in supporting a next connected or attached extension part 20. The other purpose is to assist in supporting a window covering component. To illustrate using the most distal extension part 20*c*, the top 25*c* of the body 24*c* has a tab opening 36*c* that, in this example, is positioned near but spaced from the rear end 28*c*. The length of the projecting segment 32*b* of the next adjacent (intermediate) element 22*b* defines a gap "G" between the tab 30*b* and the front end 23*b* of the body 24*b*. The position of the tab opening 36*c* relative to the rear end 28*c* of the body 24*c* corresponds to this gap "G." On the mounting base 12, the gap "G" is defined between the tab 30 and the base plate 13.

When the extension part 20*c* is connected to the part 20*b* to increase the length of the bracket assembly 10, the exposed tab 30*b* is received in the corresponding opening 36*c* and hooks onto the support element 22*b*. The previously last exposed extension part 22*b* is received and captured within the space "S" in the body 24*c* through the rear opening 29*c* and the bottom opening 24*c*. The rear ends 28*c* of the part 20*c* bear against the front end 23*b* of the part 20*b*.

In this configuration, when the part 20*c* is attached to the bracket assembly 10, the support element 22*b* of the intermediate part 20*b* assists in supporting the most distal part 20*c*. The most distal exposed support element 22*c* can then either be use to support a window covering component (not shown) or to connect another extension part 20 (not shown). If the bracket assembly 10 were to be shortened, the part 20*c* can be removed, exposing the extension part 20*b* as the most distal part. The exposed support element 22*b* can then be used to support a window covering component instead of the part 20*c*.

The intermediate part 20*b*, and other intermediate parts (if utilized), would be connected or removed in essentially the same way. The most proximal part 20*a* also attaches in essentially the same way to the base 12. The support element 34 of the mounting base 12 is received within the space "S" in the body 23*a*, and the rear ends 28*a* bear against the base plate 13.

In the disclosed example, the support element 34 of the mounting base 12 can also be used to support either the most proximal extension part 20*a*, as shown, or a window covering component, if desired. Each of the extension parts 20 can be removed and the mounting base 12 alone can be used to mounting window covering hardware in the shortest length bracket configuration.

As shown in FIGS. 1–3, the bracket assembly can include a snap-together feature, if desired, to assist in holding the components together when connected. In the disclosed example, the extension parts 20 have a recess 40 on an interior surface 42 of each of the body sides 26. A corresponding detente rib 44 is formed on each exterior side 46 of the projecting section 32 of the support elements 22. In this example, the ribs 44 and recesses 40 extend generally horizontally are slightly elongate in shape. As will be evident to those having ordinary skill in the art, the ribs and recesses can alternatively be circular or some other shape as desired. When two adjacent parts 20 (or one part 20 and the base 12) are connected, each rib 44 snaps into the corresponding recess 40.

The space "S" within each part 20 and the projecting section 32 of an adjacent part can also be formed having complimentary shapes that provide a snap fit or a positive detente when connected. A snap fit and/or a snug fit between spaces "S" and section 32 can enhance the strength of the overall assembly 10 when in use, especially where a plurality of parts 20 are utilized to form a relatively lengthy assembly.

Figure 5:
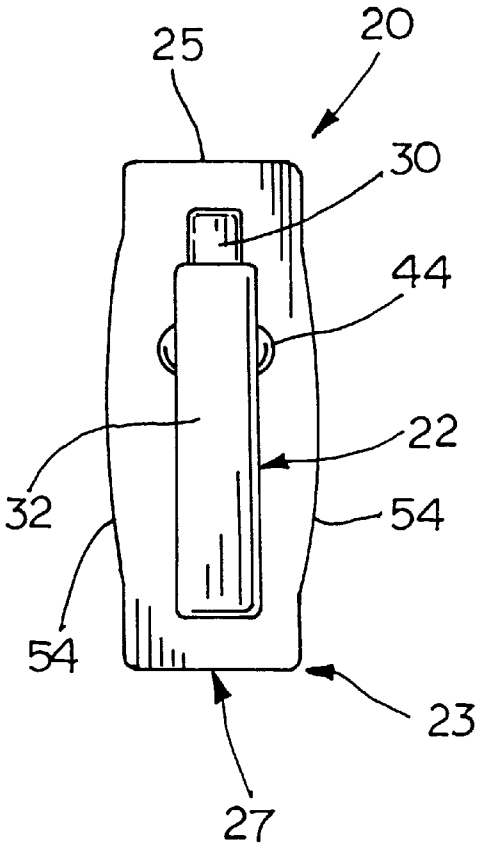
FIG. 5 is a front end view of another example of an extension part of the extendable bracket assembly shown in FIG. 1.
Figure 4:
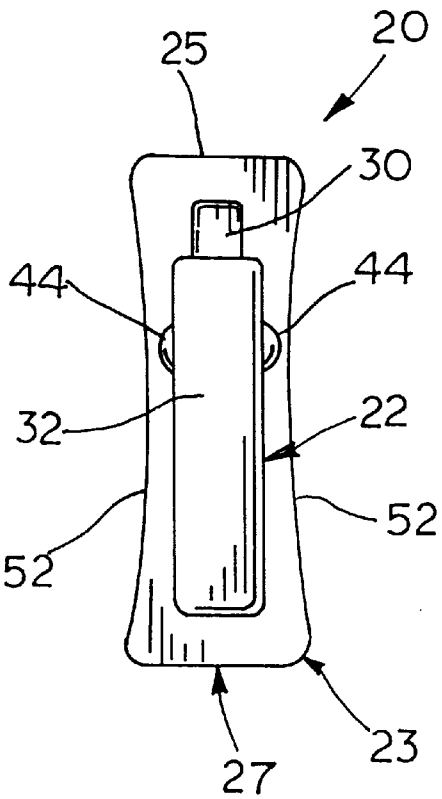
FIG. 4 is a front end view of one example of an extension part of the extendable bracket assembly shown in FIG. 1.

As shown in FIGS. 4 and 5 by way of example, the shape of the body 23 of the parts 20 can vary considerably and yet fall within the scope of the present invention. An exterior surface of the sides 46 of the bodies 23 can include different surface shapes, features, and raised or recessed artistic details to enhance the aesthetic characteristics of the assembly 10 without affecting the performance. FIG. 4 shows a body 23 having a recessed region 52 between the top 25 and the bottom opening 27. FIG. 5 shows a body 23 having a bulging region 54 between the top 25 and the bottom opening 27.

To use the bracket assembly 10, the mounting base 12 is attached to a surface as desired using the holes in the base plate 13. The removable and reusable extension parts 20 of the support section 14 disclosed herein can be added to or removed from the mounting base 12, as needed, to either increase or decrease the length of the mounting bracket assembly. To adjust the length of the mounting bracket assembly 10, a user determines the desired position from the mounting surface of a wall covering component that is to be supported by the assembly. Once determined, the correct number of extension parts 20, if any are needed, can be added to or removed from the base 12. Unused parts 20 can be stored for later reuse. The last exposed support element 22 is then utilized for supporting a window covering component.

The disclosed mounting bracket 10 has a plurality of identical extension parts 20 and support elements 22 and 34. In other examples, each part and/or each support element can be different in configuration. Each part and support element can be adapted to support a different type of window covering component. Each part 20 can be further adapted to connect to the mounting base 12 directly, changing the characteristics of the exposed support element 22 as desired. Alternatively, the parts 20 can be adapted to attach to one another so that the length of the bracket and the characteristics of the exposed element 22 can be altered as needed. The extendable bracket disclosed herein can typically be used to support curtain rods for hanging curtains. Two or more brackets, at least one on each end of the rod, can be used to support the rod. The disclosed bracket, however, is not limited to such use. The mounting base and the support section including the support elements can be modified to support other types of window coverings and/or other types of hardware components as well.

The disclosed bracket improves upon the above described problems with existing mounting hardware. The extendable bracket disclosed herein can replace the several different fixed projection brackets that retailers typically carry. This reduces the amount of information tracking required for product manufacture, storage, sales, shipping, and in-store stock. The disclosed single bracket also reduces the amount of SKU numbers to track and reduces the number of required product packaging labels and store display labels. The disclosed bracket also reduces the amount of in-store real estate required to accommodate curtain rod, window covering, and mounting hardware products. The consumer's job is also made easier. The consumer need not select from one of several bracket options, but instead can simply alter the single disclosed bracket at home to fit a particular job.

Although certain extendable brackets have been disclosed and described herein in accordance with the teachings of the present invention, the scope of coverage of this patent is not limited thereto. On the contrary, this patent covers all embodiments of the teachings of the invention fairly falling within the scope of the appended claims, either literally or under the doctrine of equivalents.

What is claimed is:

1. An extendable bracket assembly for supporting hardware components, the bracket assembly comprising:

a mounting base having a base plate with an attachment side, a support side opposite the attachment side, and a base support element that extends from the support side; and a first extension part having a first body with a proximal end adjacent the mounting base and a first extension support element extending from an opposite distal end of the first body, the first body having a pair of spaced apart first sides, a closed top interconnecting the first sides, a rear opening, and an interior space defined between the first sides and the closed top, wherein the base support element is received in the interior spaced through the rear openings, wherein the first extension part can be removed from and reattached to the base support element, and wherein the base support element is exposed when the first extension part is removed.

2. A bracket assembly according to claim 1, wherein the base support element and the first extension support element are essentially identical to one another.

3. A bracket assembly according to claim 1, further comprising:

a second extension part having a second body with a proximal end adjacent the distal end of the first body, and having a second extension support element extending from an opposite distal end of the second body, wherein the second extension part can be removed from and reattached to the first extension support element of the first extension part, and wherein the first extension support element is exposed when the second extension part is removed.

4. A bracket assembly according to claim 3, further comprising:

one or more additional extension parts attached in series to the second extension part, each additional extension part constructed essentially identical to the second extension part and having a corresponding additional support element, wherein each additional extension part can be removed from and reattached to a respective more proximal additional support element to expose a selected one of the additional support elements.

5. A bracket assembly according to claim 1, further comprising:

a projecting section of the base support element attached to and extending from the support side of the base plate;

a tab extending upward from the projecting section and being spaced from the base plate; and a tab opening formed in the closed top of the first body section into which the tab is received.

6. A bracket assembly according to claim 5, further comprising:

a projecting section of the first extension support element attached to and extending from the distal end of the first body;

a tab extending upward from the projecting section and being spaced from the distal end of the first body.

7. A bracket assembly according to claim 1, further comprising:

a snap-together detente mechanism provided between the base support element and the first body.

8. A bracket assembly according to claim 7, wherein the snap-together detente mechanism comprises:

at least one recess provided on one of the first body and the base support element; and at least one raised rib provided on the other of the first body and the base support element, wherein the at least one raised rib is received in the at least one recess.

9. A bracket assembly according to claim 1, wherein the mounting base and the and the first extension part are each formed from a plastic material.

10. A bracket assembly according to claim 1, wherein the first body further comprises:

a closed front interconnecting the first sides and from which the first extension support element extends.

11. A bracket assembly according to claim 10, wherein each of the first sides has a rear end adjacent the rear opening that bears against the support side of the base plate.

12. A bracket assembly for supporting window covering components, the bracket assembly comprising:

a mounting base having a base plate with an attachment side, a support side, and a base support-element extending from the support side; and a first extension part having a first body with an open first rear end, a first interior space, and a first extension support element extending from a closed first front end of the first body, wherein the first extension part can be removed from and reattached to the base support element, and wherein the base support element is received in the first interior space, and wherein the base support element is exposed when the first extension part is removed.

13. A bracket assembly according to claim 12, further comprising:

a second extension part having a second body with an open second rear end, a second interior space, and a second extension support element extending from a closed second front end of the second body, wherein the second support element can be removed and reattached to the first extension support element of the first extension part, and wherein the first extension support element is exposed when the second extension part is removed.

14. A bracket assembly according to claim 12, further comprising:

one or more additional extension parts attached in series to the second support element, each additional extension part constructed essentially identical to the second extension part and having a corresponding additional support element received in a next adjacent additional interior space, wherein each additional extension part can be removed from and reattached to a respective more proximal additional support element to expose a selected one of the additional support elements.

15. A bracket assembly according to claim 12, wherein the base support element has an upwardly extending base tab spaced from the support side of the base plate that is received in a corresponding first tab opening in a top of the first body.

16. A bracket assembly according to claim 13, wherein the first extension support element has an upwardly extending first tab spaced from the first front end of the first body and received in a corresponding second tab opening in a top of the second body.

17. A bracket assembly according to claim 12, further comprising:

a snap-together detente mechanism provided between the base support element and the first body within the first interior space.

18. A bracket assembly for supporting window covering components, the bracket assembly comprising:

a mounting base adapted for attachment to a surface;

a base support element extending from the mounting base and integrally formed therewith, the base support element having a projecting section connected to the mounting base and having an upwardly extending tab spaced from the mounting base; and a plurality of extension parts each having a body with a rear opening into an interior space, a front end, a top, a tab opening in the top, and an extension support element extending from the front end, wherein the plurality of extension parts are attached in series to the mounting base with the base support element received in the interior space of a most proximal extension part, and wherein each next most proximal extension support element is received in a next adjacent interior space exposing only a most distal extension support element, and any number of the extension parts can be selectively removed from and reattached in order to expose the base support element or a selected one of the extension support elements.

19. A bracket assembly according to claim 18, further comprising a snap-together detente mechanism between each of the mounting base and the plurality of extension parts.

20. A bracket assembly according to claim 18, wherein the upwardly extending tab of each support element is received in a corresponding tab opening of a next adjacent extension part.

* * * * *

UNITED STATES PATENT AND TRADEMARK OFFICE

CERTIFICATE OF CORRECTION

PATENT NO. : 6,598,843 B1
DATED : July 29, 2003
INVENTOR(S) : Ronald T. Bell et al.

It is certified that error appears in the above-identified patent and that said Letters Patent is hereby corrected as shown below:

Column 7,
Line 57, replace "base and the and the first extension" with -- base and the first extension --.

Signed and Sealed this

Twelfth Day of October, 2004

JON W. DUDAS
*Director of the United States Patent and Trademark Office*